US008144025B2

(12) United States Patent
Mackenzie, IV et al.

(10) Patent No.: US 8,144,025 B2
(45) **Date of Patent: *Mar. 27, 2012**

(54) TRACK LIGHTING SYSTEM CURRENT LIMITING DEVICE

(75) Inventors: Kenneth Mackenzie, IV, Westport Point, MA (US); Alejandro Mier-Langner, Providence, RI (US); Michael S. O'Boyle, S. Dartmouth, MA (US); James Edward Kuchar, Fall River, MA (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/025,615

(22) Filed: Feb. 11, 2011

(65) Prior Publication Data

US 2011/0133671 A1 Jun. 9, 2011

Related U.S. Application Data

(63) Continuation of application No. 12/147,180, filed on Jun. 26, 2008, now Pat. No. 7,911,351, and a continuation of application No. 11/056,309, filed on Feb. 11, 2005, now Pat. No. 7,397,384.

(51) Int. Cl.
*G08B 21/00* (2006.01)

(52) U.S. Cl. ..... 340/638; 340/635; 340/664; 307/125; 361/673

(58) Field of Classification Search ..... 340/638, 340/635, 636.12, 636.17, 639, 664; 324/509; 361/643, 673; 315/209 R; 307/125
See application file for complete search history.

(56) References Cited

U.S. PATENT DOCUMENTS

| | | | |
|---|---|---|---|
| 1,301,994 | A | 4/1919 | Archer |
| 1,885,513 | A | 11/1932 | Mask |
| 1,977,883 | A | 10/1934 | Levy |
| 2,026,884 | A | 1/1936 | Glasgow |
| 2,108,052 | A | 2/1938 | Eitzen |
| 2,614,457 | A | 10/1952 | Weber |
| 2,856,592 | A | 10/1958 | Carlson |
| 2,946,037 | A | 7/1960 | Platz |
| 3,120,985 | A | 2/1964 | Hubbell |
| 3,180,981 | A | 4/1965 | Ulffers |
| 3,273,103 | A | 9/1966 | Ericson |
| 3,298,277 | A | 1/1967 | Scharf |
| 3,391,377 | A | 7/1968 | Corl |
| 3,529,275 | A | 9/1970 | Routh |
| 3,559,146 | A | 1/1971 | Valtonen |
| 3,562,616 | A | 2/1971 | Elliott |
| 3,622,938 | A | 11/1971 | Ito |
| 3,646,501 | A | 2/1972 | Valtonen |
| 3,686,614 | A | 8/1972 | Hyrylainen |
| 3,718,886 | A | 2/1973 | Hoffmeister |
| 3,737,761 | A | 6/1973 | Walther |
| 3,757,273 | A | 9/1973 | Hesse |
| 3,760,133 | A | 9/1973 | Howard |
| 3,832,503 | A | 8/1974 | Crane |
| 3,848,715 | A | 11/1974 | Hesse |

(Continued)

*Primary Examiner* — Eric M Blount

(57) ABSTRACT

A current limiting system in accordance with the present invention comprises an accessory or canopy mount device that is permanently installed between a source of electrical power 1 and a track lighting system 2. The system may be installed integrally with a track lighting system to supply power to a plurality of lighting tracks from a plurality of power sources or circuits, as desired by a user or lighting designer. The system may also be configured to be compatible with a wide variety of track lighting system power tracks and is difficult to remove once properly installed, thereby making it tamper-proof.

7 Claims, 5 Drawing Sheets

Figure 1:
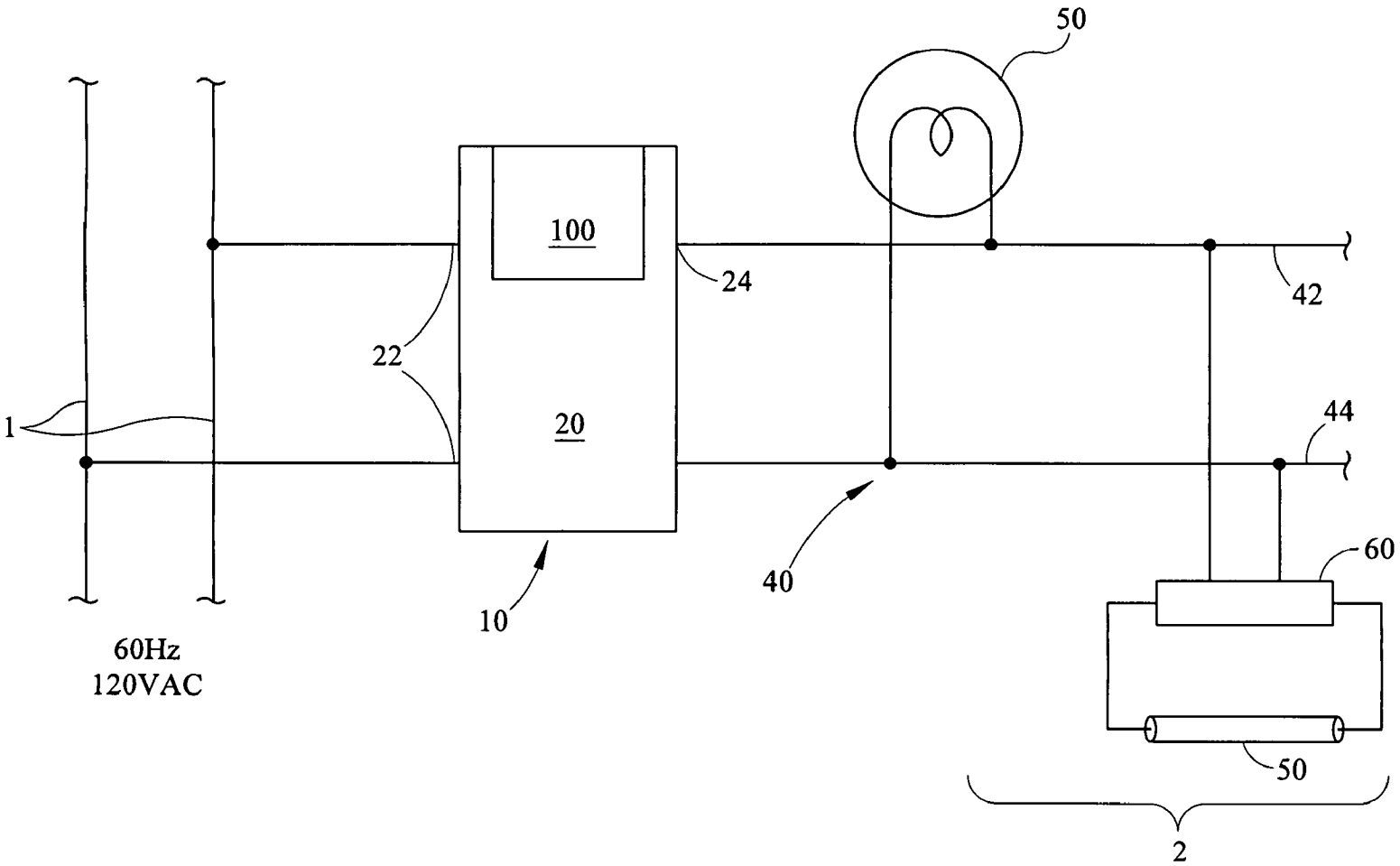

U.S. PATENT DOCUMENTS 3,884,541 A 5/1975 O'Nan
3,894,781 A 7/1975 Donato
3,896,355 A 7/1975 Guicheteau
3,933,403 A 1/1976 Rubesamen
3,940,634 A 2/1976 Grogan
3,959,644 A 5/1976 Dammel
3,971,967 A 7/1976 Hawkins
3,980,368 A 9/1976 Fremont
3,993,385 A 11/1976 Seger
4,001,571 A 1/1977 Martin
4,007,378 A 2/1977 Lazzara
4,029,378 A 6/1977 Bolis
4,032,208 A 6/1977 Berkenhoff
4,052,625 A 10/1977 Cameron
4,053,194 A 10/1977 Gilman
4,085,988 A 4/1978 Gamble
4,108,523 A 8/1978 Bolis
4,118,658 A 10/1978 Salva
4,139,252 A 2/1979 Gorny
4,181,388 A 1/1980 Donato
4,200,862 A 4/1980 Campbell
4,211,460 A 7/1980 Seelbach
4,218,108 A 8/1980 El Mouchi
4,250,437 A 2/1981 Morton
4,289,365 A 9/1981 Rutgers
4,298,869 A 11/1981 Okuno
4,319,114 A 3/1982 Bell
4,352,993 A 10/1982 Hannas
4,375,106 A 2/1983 Voll
4,392,187 A 7/1983 Bornhorst
1,879,600 A 9/1983 Burchett
4,508,400 A 4/1985 Herbert
4,533,190 A 8/1985 Booty
4,557,547 A 12/1985 Stuart
4,584,506 A 4/1986 Kaszmann
4,598,345 A 7/1986 Kleeman
4,626,747 A 12/1986 Nilssen
4,651,059 A 3/1987 Nilssen
4,655,520 A 4/1987 Cummings
4,667,133 A 5/1987 Nilssen
4,670,699 A 6/1987 Yang
4,676,567 A 6/1987 Mouchi
4,684,822 A 8/1987 Angott
4,688,154 A 8/1987 Nilssen
4,699,439 A 10/1987 Cohen
4,701,833 A 10/1987 Bornhorst
4,712,167 A 12/1987 Gordin
4,722,030 A 1/1988 Bowden
4,748,532 A 5/1988 Commander
4,779,168 A 10/1988 Montgomery
4,790,766 A 12/1988 Booty
4,797,795 A 1/1989 Callahan
4,822,292 A 4/1989 Thayer
4,861,273 A * 8/1989 Wenman et al. ..... 439/111
4,887,196 A 12/1989 Brown
4,947,302 A 8/1990 Callahan
4,968,262 A 11/1990 Widell
4,992,709 A 2/1991 Griffin
5,013,251 A 5/1991 Stringer
5,031,082 A 7/1991 Bierend
5,038,261 A 8/1991 Kloos
5,047,696 A 9/1991 Nilssen
5,055,746 A 10/1991 Hu
5,072,216 A 12/1991 Grange
5,151,038 A 9/1992 Range
5,176,442 A 1/1993 Richardson
5,180,952 A 1/1993 Nilssen
5,191,501 A * 3/1993 Blau ..... 361/95
5,192,126 A 3/1993 Remeyer
5,209,560 A 5/1993 Taylor
5,329,431 A 7/1994 Taylor
5,336,097 A 8/1994 Williamson
5,347,431 A 9/1994 Blackwell
5,382,947 A 1/1995 Thaler
5,406,176 A 4/1995 Sugden
5,502,627 A 3/1996 Hunt
5,506,715 A 4/1996 Zhu
5,526,245 A 6/1996 Davis
5,554,979 A 9/1996 Kohar
5,563,472 A 10/1996 Cassidy
5,593,224 A 1/1997 Kunkel
5,637,964 A 6/1997 Hakkarainen
5,640,069 A 6/1997 Nilssen
5,664,876 A * 9/1997 Vafai et al. ..... 362/249.01
5,691,603 A 11/1997 Nilssen
5,731,664 A 3/1998 Posa
5,769,531 A 6/1998 Hunt
5,803,755 A 9/1998 Kuchar
5,855,485 A 1/1999 Patti
5,921,659 A 7/1999 Hunt
5,938,362 A 8/1999 Bastiansen
5,988,838 A 11/1999 Rudenberg
5,989,067 A 11/1999 Morgan
6,004,005 A 12/1999 Demshki
6,032,432 A 3/2000 Patti
6,079,992 A 6/2000 Kuchar
6,120,262 A 9/2000 McDonough
6,127,925 A 10/2000 Bonsignore
6,130,412 A 10/2000 Sizemore
6,163,275 A 12/2000 Hartzell
6,169,377 B1 1/2001 Bryde
6,174,073 B1 1/2001 Regan
6,192,282 B1 2/2001 Smith
6,220,721 B1 4/2001 Chan
6,246,182 B1 * 6/2001 Yamasaki et al. ..... 315/209 R
6,273,587 B1 8/2001 Demshki
6,300,725 B1 10/2001 Zinkler
6,515,437 B1 2/2003 Zinker
6,567,032 B1 5/2003 Mullaly
6,597,129 B2 7/2003 Newman
RE38,259 E 10/2003 Kuchar
6,655,817 B2 12/2003 Devlin
6,667,578 B2 12/2003 Lansing
6,687,487 B1 2/2004 Mosebrook
6,700,333 B1 3/2004 Hirshi
6,774,607 B2 8/2004 Moseneder
6,897,747 B2 5/2005 Brandon
7,018,072 B2 3/2006 Mier-Langner
7,024,119 B1 4/2006 Mier-Langner
7,027,736 B1 4/2006 Mier-Langner
7,038,400 B2 * 5/2006 Rimmer et al. ..... 315/291
7,111,957 B2 9/2006 Bernhart
7,175,300 B1 2/2007 Medeiros
7,397,384 B1 7/2008 MacKenzie, IV
7,513,675 B2 4/2009 Mier-Langner
7,911,351 B2 * 3/2011 Mackenzie et al. ..... 340/638
2004/0033708 A1 * 2/2004 Joseph et al. ..... 439/110
2005/0258921 A1 * 11/2005 Puskar et al. ..... 335/17

* cited by examiner

TRACK LIGHTING SYSTEM CURRENT LIMITING DEVICE

CROSS-REFERENCE TO RELATED APPLICATIONS

The instant application claims the benefit of and is a continuation of co-pending U.S. patent application Ser. No. 11/056,309 entitled "Track Lighting System Current Limiting Device" filed Feb. 11, 2005.

BACKGROUND OF THE INVENTION

Field of the Invention

The present invention relates generally to a current limiting device and more specifically to a modular, tamper-proof current limiting device for use in track lighting systems.

BRIEF DESCRIPTION OF THE DRAWING FIGURES

FIG. 1 is schematic diagram in accordance with one embodiment of the present invention.

Figure 2:
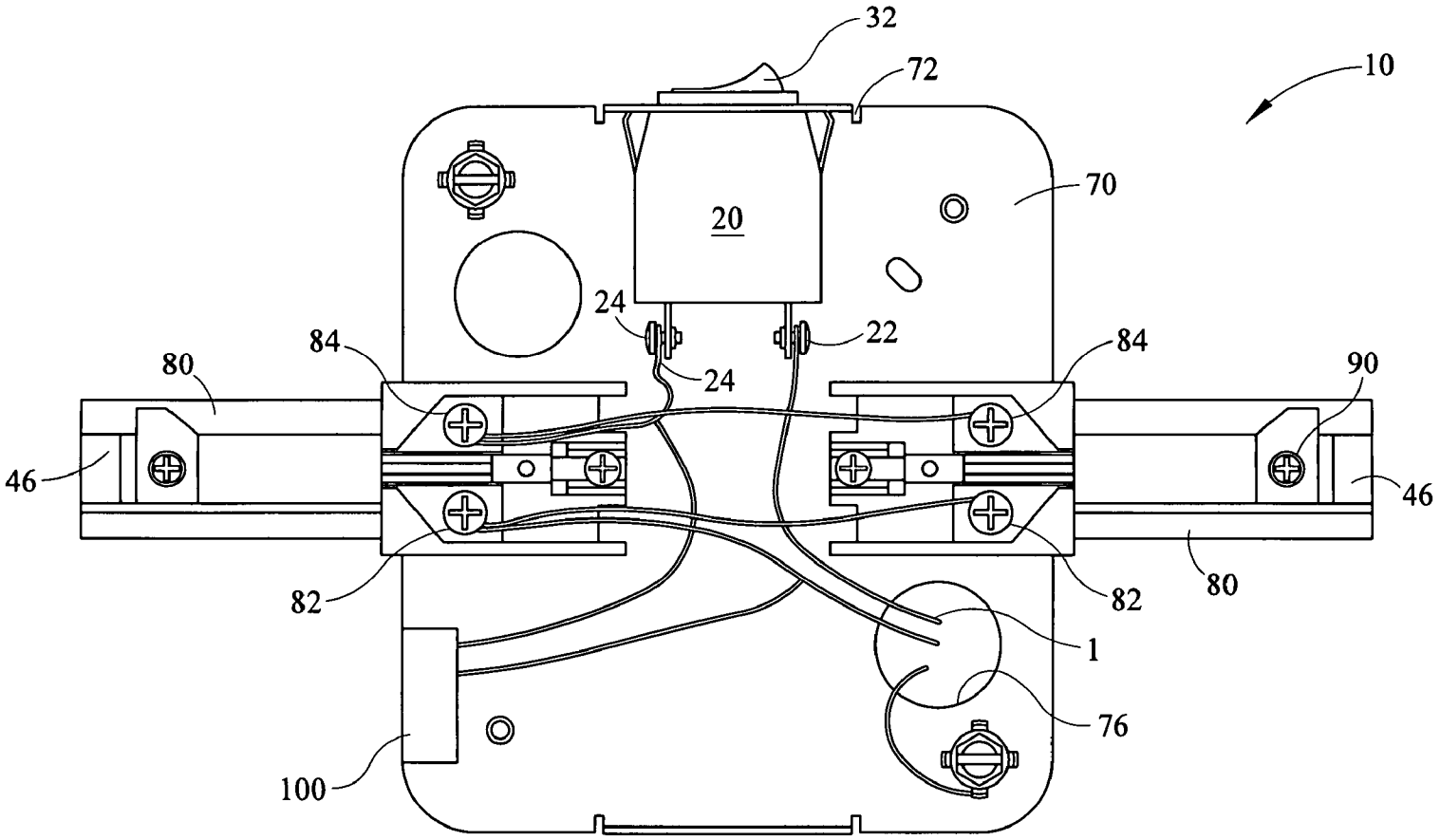
Figure 3:
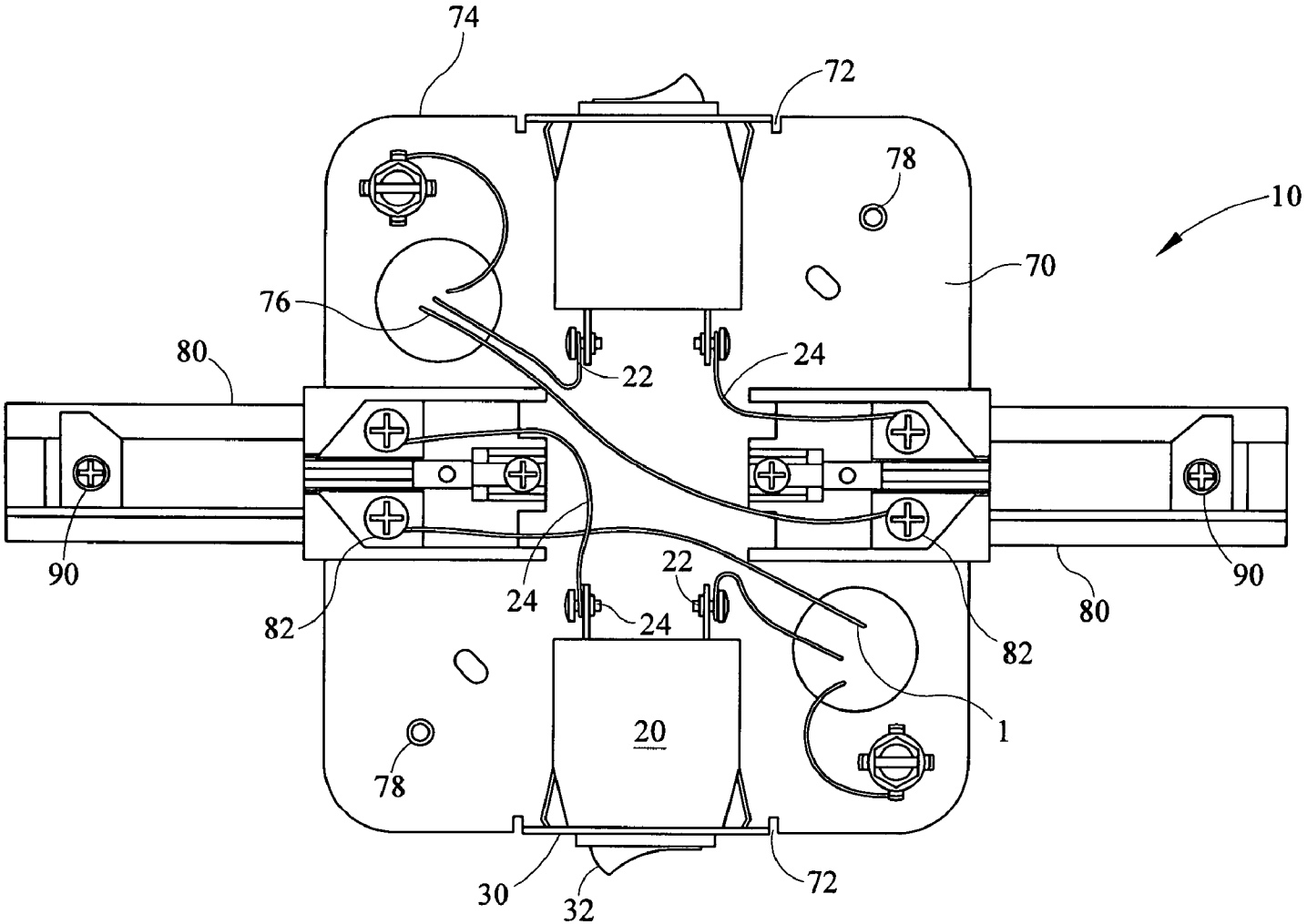
Figure 4:
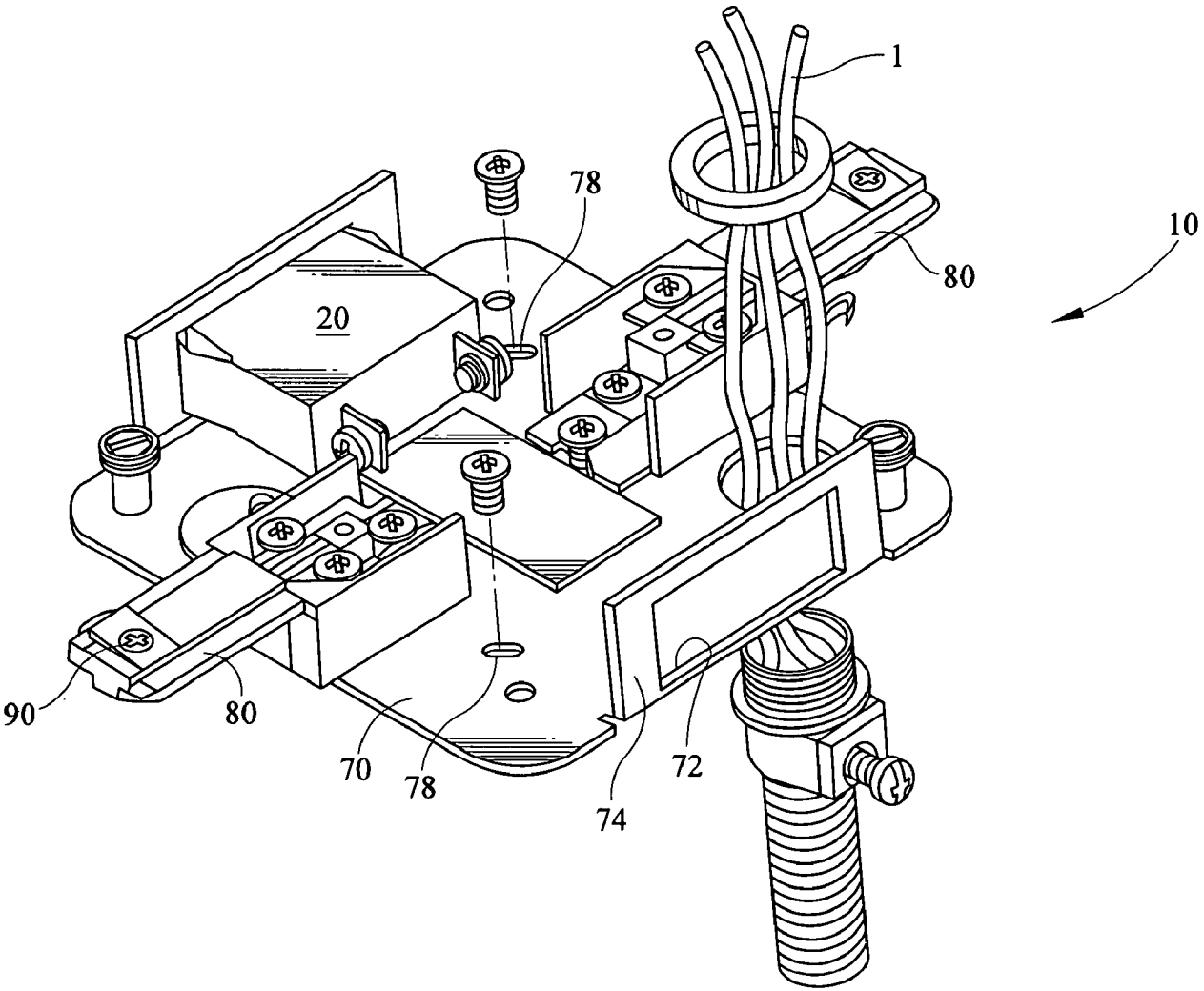
Figure 5:
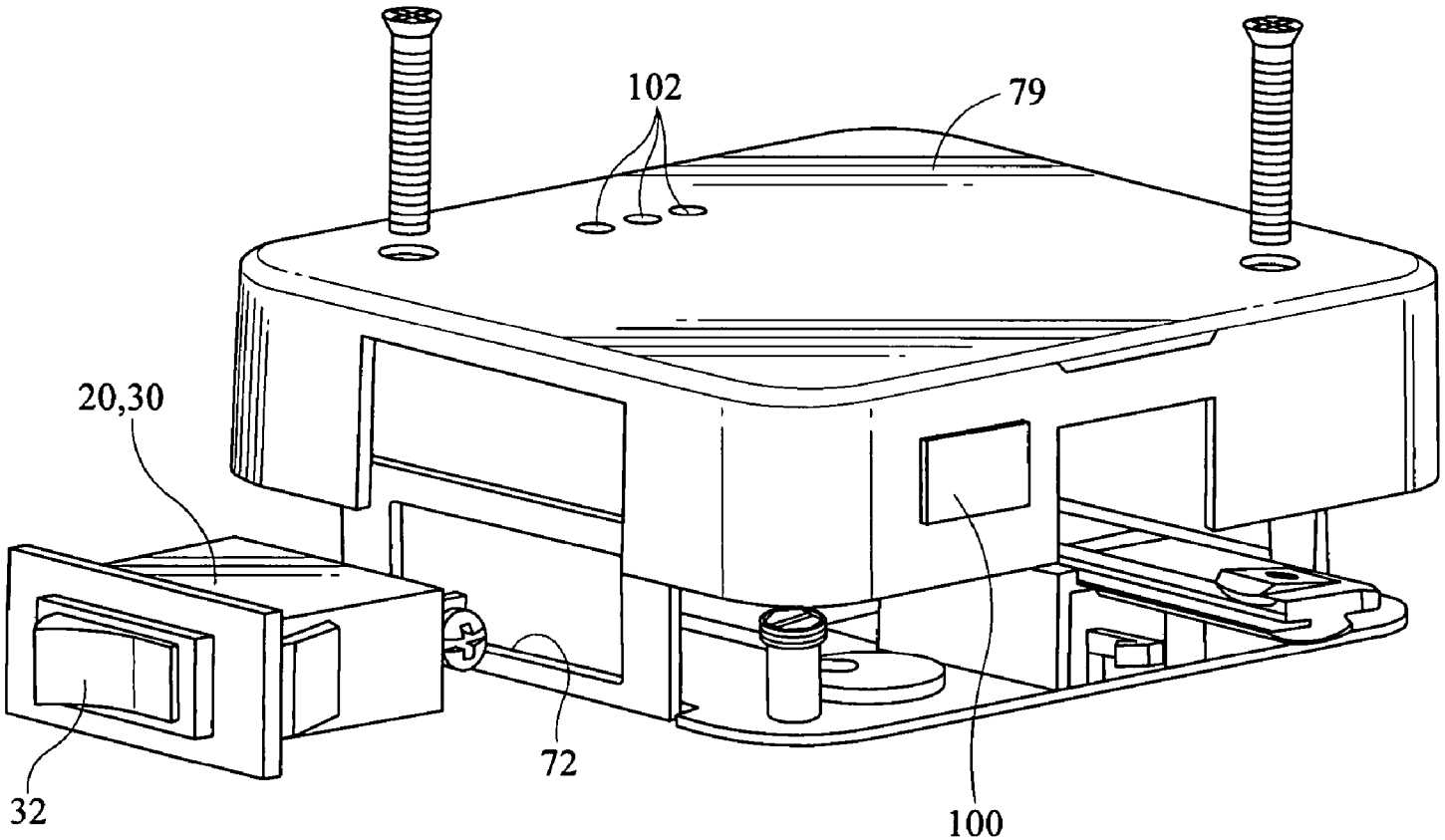

FIG. 2 is a plan view of the system of the present invention in accordance with one embodiment thereof FIG. 3 is a plan view of the system of the present invention in accordance with one embodiment thereof FIG. 4 is an exploded view of the system of the present invention in accordance with one embodiment thereof FIG. 5 is an isometric view of the system of the present invention in accordance with one embodiment thereof.

DETAILED DESCRIPTION OF THE PREFERRED EMBODIMENT(S)

Referring now to the drawing Figures, and in accordance with a preferred constructed embodiment of the present invention, the system of the present invention provides a current limiting device for use integrally with, for example, a track lighting system. The instant invention will permit a user or installer to limit the electrical current that it is possible to supply to a section of lighting track, thereby permitting its use under local electrical or energy conservation code provisions that require lighting track to be limited to a predetermined wattage per linear foot, whether that track is being utilized to supply power to a lamp or not.

The current limiting system of the present invention is an accessory or canopy mount device that is permanently installed between a source of electrical power 1 and a track lighting system 2. Furthermore, the system may be installed integrally with a track lighting system to supply power to a plurality of lighting tracks from a plurality of power sources or circuits, as desired by a user or lighting designer. The system may also be configured to be compatible with a wide variety of track lighting system power tracks and is difficult to remove once properly installed, thereby making it tamper-proof The present invention may include as a current limiting device a conventional circuit breaker, fuse, current limiting relay, or thermistor, or alternatively a plurality thereof that are installed in apertures in a mounting canopy. This feature of the present invention permits an installer or designer to size the breaker for the amount of track to be powered by the system in order to comply with any applicable code.

As seen in FIGS. 1-5, the system 10 of the present invention comprises at least one current limiting device 20 that includes an input 22 for accepting electrical power from a power source 1, and an output 24 for supplying the electrical power to a track lighting system 40 that may have a plurality of lamps 50 connected thereto. The track lighting system 40 includes a pair of electrical conductors 42 and 44 that carry electrical power to the lamps 50 secured to track rail 46, as is known in the art. Furthermore, the system 10 may include a conventional ballast 60, or a plurality thereof for starting fluorescent or high intensity discharge lamps. While the present specification will refer to a system 10 that operates using 120 VAC single phase electrical power, one of ordinary skill in the art will appreciate that the present system may be employed with a wide variety of power distribution systems and circuits, including multi-phase power circuits and DC power circuits.

The current limiting device 20 may comprise a circuit breaker 30 having a reset switch 32 for connecting and disconnecting the power source 1 from the track lighting system 40 as well as resetting the breaker 30 when tripped. The circuit breaker 30 may be selected to trip at a predetermined current level as necessary to protect a predetermined length of track rail 46, or comply with applicable codes. For example, the circuit breaker may be sized to trip when a current level within a predetermined percentage over a maximum limit is reached based on the linear feet of track rail 46 used in a given installation. While the present specification discusses primarily conventional circuit breakers 30 for use as current limiting devices 20, alternatively, a wide variety of current limiting devices 20 may be employed in the present invention, including, but not limited to fuses, current limiting relays, thermistors, solid state CLD's, current limiting diodes, and MOSFET switches.

The present invention further comprises a canopy 70 having at least one aperture 72 located in a side portion 74 thereof, into which a circuit breaker 30 may be secured such that the switch 32 of the circuit breaker may be readily accessed from the exterior of the canopy 70. A plurality of apertures 72 may be included at various locations around the canopy 70 to accommodate a plurality of circuit breakers 30. This feature of the present invention is particularly advantageous when it is necessary to supply a plurality of track lighting systems 40 from a single location, but with different power circuits. For example, FIG. 3 depicts a system 10 in accordance with the present invention that employs two circuit breakers 30 mounted in the canopy 70 for supplying two separate track lighting systems 40 from two separate power circuits.

As best seen in FIGS. 2 and 4, the canopy 70 may include a plurality of knockouts 76 that may be removed in order to secure a conventional electrical conduit to the canopy 70, and through which the power source 1 wiring may be routed. The canopy may also include a plurality of mounting holes 78 therein, that are sized to accept fasteners in order to secure the canopy to a junction box or other surface. In one embodiment of the present invention, the canopy 70 is sized such that it covers a junction box (not shown) into which power wiring is routed, as is known to one of ordinary skill in the art.

The canopy 70 also includes at least one track connector 80 designed to be secured to the track rail 46. The track connector 80 may have a pair of fasteners such as screws 82 and 84 respectively, that accept a hot wire supplied as the output 24 from the current limiting device 20, and a neutral wire from the power source 1. The screws 82 and 84 are electrically connected to the track conductors 42 and 44 respectively, thus supplying electrical power to the track lighting system 40. The canopy 70 may incorporate a plurality of track connectors 80 in order to supply a plurality of lighting tracks 46 with electrical power. A wide variety of known track connectors may be employed with the system 10 of the present invention, including "L", "X", "T", and variable angle connectors.

The track connectors 80 may include an aperture 86 that is designed to accept a fastener 90 to secure track 46 to track connector 80. In one embodiment of the present invention, a one-way screw may be used as fastener 90 such that, once installed, the track 46 and track connector 80 can not be separated without resorting to special tools. Accordingly, this feature of the invention make the system 10 tamper-proof, since it is difficult to disassemble once the one-way screw(s) are inserted. In a yet further embodiment of the present invention, a tamper-proof seal such as an adhesive label or seal may be placed over a conventional fastener 90 in order to both warn of the potential for electrical shock and inhibit unauthorized personnel from altering or disassembling the system 10.

As best seen in FIG. 5, a cover 79 may be provided that is shaped to mate with the canopy 70 and is secured thereto by conventional fasteners. The circuit breaker 30 switch 32 remains accessible to enable the breaker 30 to be reset. Furthermore, the breaker switch 32 may be a lighted switch or include a non-illuminated visual indicator (such as a color) to enable a user to determine whether the breaker 30 itself has tripped, or whether power is not present at the breaker. Furthermore, in an alternative embodiment of the present invention, the breaker switch 32 may include indicia that are visible after installation informing a user of the maximum electrical load permitted on the track circuit supplied by the breaker 30.

In a yet further embodiment of the present invention, the current limiting device 20 may include a visual electrical load indicator 100 to indicate power or current in a given track circuit. The load indicator 100 may comprise a conventional digital or analog meter, or simply a plurality of light emitting diodes 102 to indicate power or current load. Where diodes 102 are employed, various colors could, for example, be utilized to indicate operation within a predetermined load range. As one example, a green led may be energized when the current limiting device is within a normal range, a yellow led may be energized when the current limiting device is within a predetermined percentage of maximum load, and a red led may be energized when the current limiting device is overloaded or tripped. The visual indicator or LED's are preferably visible through an aperture or apertures in the cover 79. One of ordinary skill will appreciate that a wide variety of circuits may be employed to supply the load indicator 100 and/or diodes with a signal to indicate current or power usage through the current limiting device 20.

The foregoing detailed description of the embodiments of the present invention is presented primarily for clearness of understanding and no unnecessary limitations are to be understood or implied therefrom. Modifications to the present invention in its various embodiments will become obvious to those skilled in the art upon reading this disclosure and may be made without departing from scope of the invention encompassed by the claims appended hereto.

We claim:

1. A current limiting system for limiting the electrical current supplied by a source of electrical power to a track lighting circuit comprising:

at least one conditional current limiting device to limit electrical power to said track lighting circuit in an over current situation and otherwise output a received voltage substantially unaltered;

at least one lighting track connector electrically coupled to said at least one current limiting device; and wherein said lighting track connector is securable to said track lighting circuit.

2. A current limiting system for limiting the electrical current supplied by a source of electrical power to a track lighting circuit as claimed in claim 1 comprising:

a plurality of current limiting devices; and a plurality of lighting track connectors.

3. A current limiting system for limiting the electrical current supplied by a source of electrical power to a track lighting circuit as claimed in claim 1 wherein said lighting track connector is capable of being secured to a current-carrying lighting track.

4. A current limiting system as claimed in claim 1 wherein said current limiting device comprises a visual load indicator for monitoring the electrical power supplied to said circuit.

5. A current limiting system as claimed in claim 1 wherein said visual load indicator comprises a plurality of light emitting diodes indicative of predetermined amounts of power supplied to said circuit.

6. A current limiting system as claimed in claim 1 wherein said current limiting device is sized to limit electrical current to a predetermined maximum based upon the length of track secured thereto.

7. A current limiting system as claimed in claim 1 wherein said at least one current limiting device comprises a circuit breaker.

* * * * *